US005544563A

United States Patent [19]

Richards et al.

[11] Patent Number: 5,544,563

[45] Date of Patent: Aug. 13, 1996

[54] PRIMER CARTRIDGE LEADER FOR GUNS

[75] Inventors: Edwin A. Richards, Barrow-in-Furness; David J. Balch, Ulverston; Howard Atherton, Arnold, all of United Kingdom

[73] Assignees: Vickers Shipbuilding & Engineering Ltd., Cumbria; Royal Ordinance PLC, Nottingham

[21] Appl. No.: 168,054

[22] Filed: Dec. 9, 1993

[30] Foreign Application Priority Data

Dec. 9, 1992 [GB] United Kingdom ..... 9225754

[51] Int. Cl.[6] ..... F41A 3/10

[52] U.S. Cl. ..... 89/24; 89/26; 89/27.13; 89/47; 42/50

[58] Field of Search ..... 42/50; 89/17, 22, 89/24, 26, 27.13, 47

[56] References Cited

U.S. PATENT DOCUMENTS

| | | | |
|---|---|---|---|
| 922,268 | 5/1909 | Dawson et al. | 89/27.13 |
| 999,387 | 8/1911 | Mauser | 42/50 |
| 1,095,558 | 5/1914 | Dawson et al. | 89/27.13 |
| 4,278,008 | 7/1981 | Smith et al. | 89/156 |

FOREIGN PATENT DOCUMENTS

| | | | |
|---|---|---|---|
| 110167 | 3/1918 | United Kingdom | 89/27.13 |
| 885361 | 12/1961 | United Kingdom . | |
| 1463530 | 2/1977 | United Kingdom . | |
| 1581091 | 12/1980 | United Kingdom . | |
| 2115535 | 9/1983 | United Kingdom . | |
| 2128303 | 4/1984 | United Kingdom . | |
| 2240385 | 7/1991 | United Kingdom . | |
| 10404 | 12/1988 | WIPO | 42/50 |

OTHER PUBLICATIONS

Search Report in UK 9225754.2.

*Primary Examiner*—Stephen C. Bentley
*Attorney, Agent, or Firm*—Pollock, Vande Sande & Priddy

[57] ABSTRACT

A first member, such as a primer cartridge (33), is inserted in an aperture in a second member, such as a chamber (8) in a gun breech block (4,5), by means of an apparatus such as a primer loader (52), comprising a tubular member whose bore (16) serves as a guide for positioning the first member and which is aligned with the aperture in the second member. A fourth member, such as a ramming rod (19), may be provided to move the first member into the guide and thence into the aperture as the fourth member advances from a first to a second position. In the case where the primer cartridge passes across a gap (18) in order to enter the aperture, the fourth member may be arranged to advance an additional distance to a third position wherein the additional distance is not less than the width of the gap, the additional distance being the permitted movement of a fifth member, such as a slidable bush (38), between two positions. A magazine (22) may be provided to store and feed a plurality of first members into the apparatus.

12 Claims, 9 Drawing Sheets

PRIMER CARTRIDGE LEADER FOR GUNS

This invention relates to the movement of members and, more particularly, but not exclusively, is concerned with moving a first member in the form of a primer cartridge into a second member in the form of a breech block of heavy field artillery, including mobile howitzers.

Personnel in modern armies are usually highly trained and will discharge their duties in a professional and competent manner. However, any battlefield is a traumatic place and it is not unknown for experienced personnel to make mistakes. Clearly, when firing heavy artillery, eg. howitzers, any mistake could be costly in terms of both personnel and materiel. Consequently, the mechanisms required to operate and fire such artillery must:

(a) be straightforward and logical to use;

(b) be highly reliable;

(c) not be able to fail in a potentially dangerous manner; and (d) be robustly constructed to suit battlefield conditions.

Previously, ammunition was 'cased', ie. the charge was sealed into a metal tube, closed at the rear, and incorporated the primer. With such ammunition the impact of a simple firing pin onto the percussion cap would detonate the charge and the casing acted to seal the combustion gases from the breech. After firing, the casing is removed from the breech and discarded.

Some modern ammunition is not cased and so requires an obturator to seal the breech against egress of the hot combustion gases; in view of the enormous gas pressures generated, this sealing is a very arduous duty. The conventional obturators used with single piece sliding breeches are reasonably efficient, and the small quantity of combustion gas that escapes is acceptable on field artillery operated in the open air. However, this level of sealing is not good enough for use inside self-propelled howitzers, or tanks, where any leakage from the breech is into the closed interior of the vehicle.

Arguably, the most efficient obturator is the Crossley Pad design (described in the specification of British Patent Application No. 80 02425) and a two-part sliding breech has been designed to accommodate this. A disadvantage of this breech design is that the primer cartridge has to be loaded across a gap. It is an object of the invention to provide a completely new, high-integrity design of primer cartridge loading system for this breech mechanism which is being used for the first time in a new item of artillery.

According to a first aspect of the invention, there is disclosed an apparatus which comprises (i) a first member, (ii) a second member having an aperture, (iii) a guide formed by a third member for positioning said first member and being aligned with said aperture of said second member, and (iv) means for moving said first member into said guide and thence into said aperture of said second member.

In an embodiment of said first aspect of the invention, the apparatus includes a plurality of said first members and means is provided to move each of said first members consecutively into said aperture aligned with said guide. The, or each, first member may be drawn from a store, positioned near the guide and moved into the aligned aperture where a particular operation may be performed. Then the first member may be removed from the aperture for further processing, etc. Thereafter a second first member may be drawn from the store and the process repeated, placing the second first member into the aperture.

The means to move said first member in said guide and into said aperture of said second member may be a fourth member movable within the confines of said guide. In this case, the movement of said fourth member may be such that it withdraws to a first position, to allow said first member to be positioned in said guide at a pre-determined location, then advances until it contacts said first member, continues to advance and thereby moves said first member until said first member is placed in said aperture at which time said fourth member is at a second position lying within said guide in said third member, and then withdraws to said first position.

Accordingly another aspect of the invention provides a method of placing a first member in an aperture of a second member, comprising the steps of:

(a) aligning a guide formed by a third member with said aperture in said second member and placing the end of said guide in juxtaposition with said aperture;

(b) retracting a fourth member along said guide of said third member to a first position;

(c) positioning said first member in said guide; and (d) advancing said fourth member until it contacts said first member and continuing to advance said fourth member until it is in a second position where said first member is correctly positioned in said aperture in said second member.

In carrying out the method, said first member may be aligned or re-aligned as it approaches the end of said guide. Also, in an embodiment, a supply of said first members is held in a magazine and each of said first members is fed singly and consecutively into said guide each time said fourth member is retracted.

According to an embodiment of the invention, said aperture is separated from the end of said guide adjacent to said second member so that there is a gap across which said first member has to pass in order to be placed in said aperture and said apparatus incorporates a means for advancing said fourth member an additional distance to a third position, said additional distance being not less than the width of said gap. In this case, the fourth member is retracted back into said third member after having completed its additional advancement to said third position. The additional advancement of said fourth member to said third position may be controlled by a fifth member, slidably mounted for movement between first and second positions in a direction parallel to the direction of movement of said fourth member with the limit of permitted movement of said fifth member being not less than the width of said gap. The fifth member may be releasably lockable in its first position and, after releasing, be slidably movable to its second position, which is nearer said gap than said first position of the fifth member. After said fourth and fifth members have advanced to their said third and second positions respectively, a first latching mechanism may become operable to releasably lock together said fourth and fifth members and a restoring means may become operable to retract both said fourth and fifth members to their said second and first positions respectively. A second latching mechanism may become operable when said restoring means has retracted said fourth and fifth members to their said second and first positions respectively, said first and second latching means combining to lock releasably said fourth and fifth members against motion in either the retracting or advancing directions.

In use, the first and second latching mechanisms may be simultaneously released by the operation of a single means enabling the fourth member to retract from its lockable second position to its first. At the same time, the fifth member may be advanced by a spring from its first (lockable) position to its second position, nearer to the gap. After retraction to the first position, the fourth member is advanced past the second position to its third position which may be defined by the fifth member in its second position. The further advance from the second to the third position enables the fourth member to advance the first member across the gap and press it fully home into the aperture in the second member. When the fourth member reaches its third position, the first latching mechanism re-engages locking the fourth member and fifth member together. On achieving the third position, the advancing force on the fourth member is released and both the fourth member and the fifth member are retracted gently, eg. by a spring means, to their respective second and first positions, where the second latching mechanism re-establishes itself.

A resilient connection may be provided between said fourth member itself and a driving member, such as an operating handle, which supplies the advancing force to said fourth member. Preferably, the resilient connection is a spring maintaining a short axial clearance between the end of the fourth member and the operating handle when manually operated. This axial clearance is greater than the difference in distance between the additional movement permitted by the fifth member and the width of the gap. Thus, however enthusiastically the handle is advanced, the force locating the first member fully home in the aperture of the second member is that defined by the axial compressibility of the spring.

In the case where there is a gap between the end of the guide and the aperture, a means is preferably provided to align and direct said first member from said guide in said third member across said gap into said aperture in said second member. This aligning means may be in the form of a plurality of pivotally mounted elements suitably disposed in, or adjacent to, said guide at or near the end of said guide adjacent to said gap. Alternatively, the aligning means may be a plurality of resilient elements.

Preferably, the apparatus is a primer loader for a gun in which case the first member is a primer cartridge, the second member is the breech block of the gun, and the aperture is a chamber in the breech block. In this case the third member may be a tube with the guide being the bore of the tube, in the body of the primer loader. In such a preferred application of the invention, a plurality of primer cartridges may be stored in a magazine and may be fed one after the other the loader guide and then be moved into the chamber in the breech. After firing, the spent cartridge is removed from the chamber and the process repeated to load a fresh primer cartridge into the same chamber.

In the case where the apparatus is a primer loader including a magazine, the fourth member is preferably a rammer rod, which retracts past the mouth of the magazine to the first position; this allows a primer cartridge to be wholly, or partially, moved into the guide in the body of the loader. The rammer rod then advances and contacts the cartridge, moving it in the advancing direction. If the cartridge is not wholly in the guide, the first part of the advancement will be to complete the transfer of the cartridge from the magazine to the guide, eg. by pushing the cartridge along an angled lead into the guide. The rammer rod then continues to advance moving the cartridge along the full length of the guide and into the chamber in the breech block. At this point, the rammer rod stops its advance having reached the second position. It then retracts, to clear the breech, until it has returned to the first position, ie. past the mouth of the magazine, allowing the next cartridge to move wholly, or partially, into the guide. After the breech has been closed, the gun has been fired, the breech has been opened and the spent cartridge has been removed, the process of loading a fresh cartridge can be repeated.

In the case where the rammer rod is additionally advanced to a third position, the fifth member controlling the same is preferably in the form of a sliding bush moveable between first and second positions by a distance not less than the width of the gap between the chamber in the breech block and the end of the bore of the guide tube.

In the preferred design where the primer cartridge is to be passed across the gap between the end of the guide and the chamber in the breech block, it is important that the cartridge is aligned with the entrance to the chamber prior to leaving the guide and that this alignment is maintained until the leading part of the cartridge has actually entered the mouth of the chamber. Once the leading part of the cartridge has entered the mouth of the chamber, the shapes of the cartridge and the chamber will ensure correct alignment as ramming is completed. In order to achieve the required degree of alignment accuracy, pivotally mounted fingers or a collar of resilient leaf springs is used.

According to another aspect of the present invention, there is provided a magazine for holding a plurality of members and feeding them wholly, or partially, into a guide in another member, said magazine comprising:

(a) a body removably fittable into an opening in said other member communicating with said guide;

(b) a guide path in said body adapted to allow said plurality of members to fit within and move along it;

(c) a mouth, through which said plurality of members may be loaded into said magazine and discharged therefrom;

(d) lips, adjacent to said mouth, to hold said plurality of members in said magazine with one of said plurality of members wholly or partly protruding into said guide when said magazine is fitted into said opening in said other member;

(e) a platform, adapted to bear against said plurality of members and to guide them along said guide path in said body of said magazine.

(f) resilient means to urge said platform into contact with said plurality of members and move the remaining of said plurality of members to the opening of said magazine when one of said plurality of members has been removed from said mouth of said magazine; and (g) a supply of said plurality of members.

Preferably, said plurality of members is a plurality of primer cartridges and said another member is a tube with the guide being the bore of the tube and the opening being a slot in the tube communicating with the bore. It is preferred in this case, for the cartridges to be loaded singly into the magazine in a consecutive fashion and to bear against the platform which is kept in firm contact with the cartridges by a spring. Further, the guide path in the magazine may be curved and allow a considerable number of cartridges to be fed in one after another. The last cartridge to be loaded is held in the lips at the mouth of the magazine and partly protrudes therefrom. When fitted in the body of a primer loader in accordance with a preferred embodiment of the first aspect of the invention, this last cartridge is partly in the guide and is contacted by the aforementioned fourth member to cause the cartridge to move out of the lips of the magazine and fully into the guide, ahead of the fourth member.

For a clearer understanding of the invention and to show how the same may be put into effect, reference will now be made, by way of example only, to the accompanying drawings in which.

Figure 1:
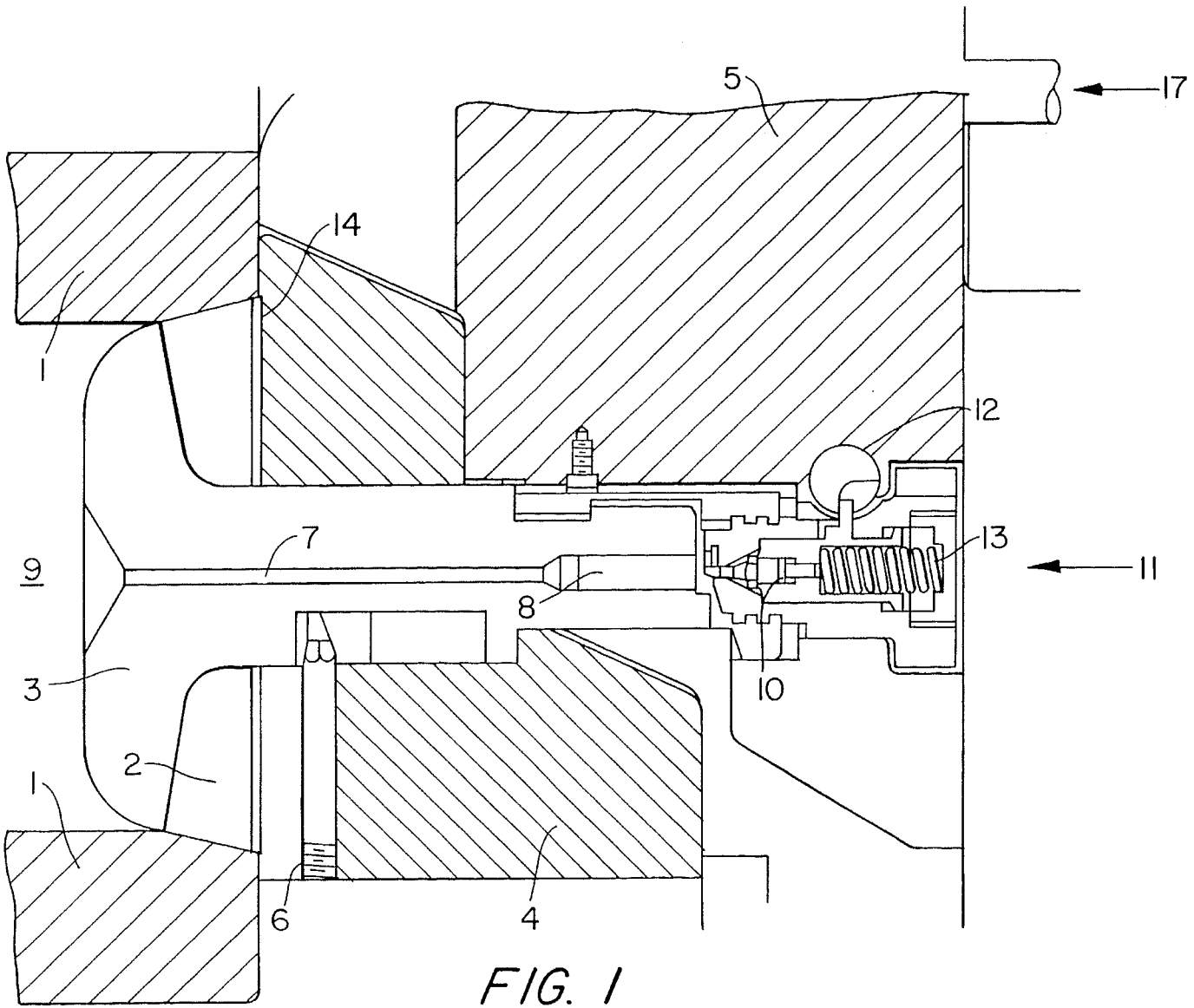
FIG. 1 is a sectional elevation of the breech and obturator assembly of a howitzer.

Referring to FIG. 1, the breech end of a howitzer barrel 1 is shown sealed by obturator 2. Passing through obturator 2 is vent axial 3 which is fast via screw 6 in lower breech block 4. Upper breech block 5 completes the two-part breech block. Vent axial 3 has an axial hole 7 which communicates between primer cartridge chamber 8 and the end of bore 9 of barrel 1, where the charge would be located. When the breech is fully closed, firing pin 10, mounted in upper breech block 5, is aligned with, and adjacent to, primer chamber 8, in lower breech block 4, both lying on the axis 11 of barrel 1.

The firing pin 10 can be withdrawn by compressing spring 13 and releasably locked in the position shown in FIG. 1 i.e. so that the firing pin is "cocked". When the howitzer is to be fired, the locking mechanism is released thus freeing firing pin shaft 12 and allowing spring 13 to propel pin 10 into the base of the primer cartridge (not shown) in chamber 8 causing it to detonate. The hot combustion gases pass along vent axial hole 7 and into bore 9, igniting the charge (not shown). The deflagration of the charges creates a very high pressure of hot combustion gases in bore 9, firing the shell (not shown) out of the muzzle of barrel 1. Obturator 2, mounted on shim 14, provides an essentially gas-tight seal so that no gas escapes towards the breech block 4,5.

Figure 2:
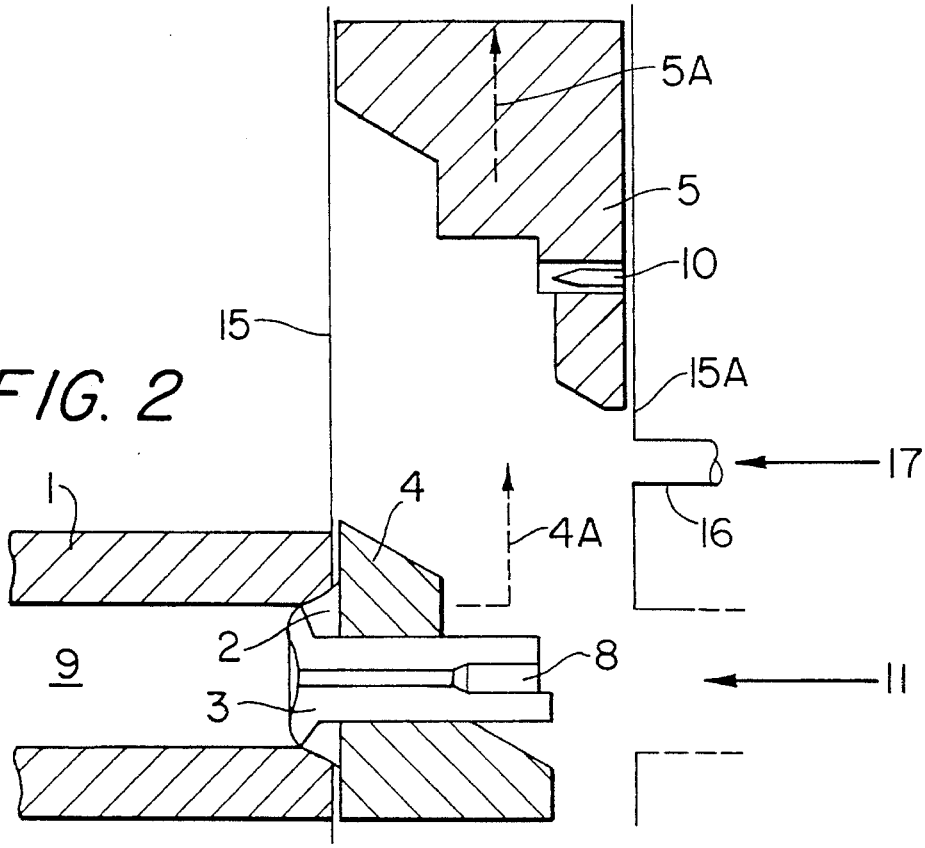
FIG. 2 is a sectional elevation of the howitzer of FIG. 1, but showing the breech partly opened.
Figure 3:
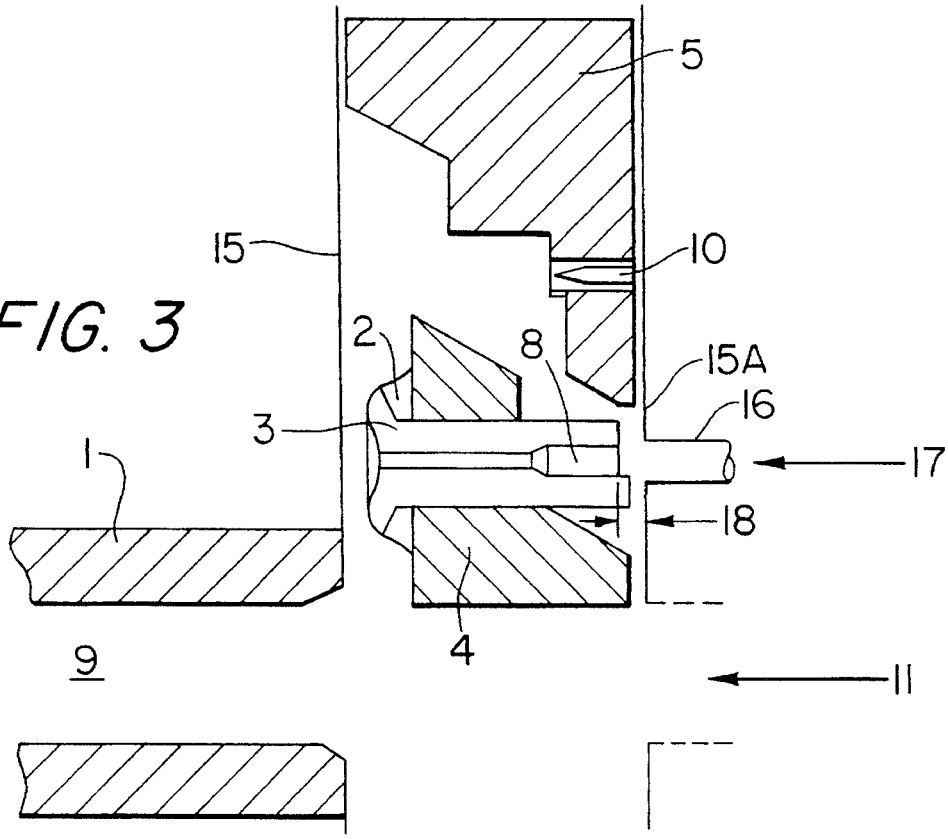
FIG. 3 is a further sectional elevation of the howitzer of FIG. 1 showing the breech fully open.

After firing, the breech is opened. The first step is to move upper breech block 5 upwards in breech guides 15,15A as shown by arrow 5A (FIG. 2). This is followed by moving lower breech block 4 rearwards and then upwards, as shown by arrow 4A (FIG. 2), so that obturator 2 and vent axial 3 are clear of bore 9 of barrel 1 before being moved upwards (FIG. 3). In this position, bore 9 is fully exposed and may be swabbed out and re-loaded, ie. as shown by axial arrow 11. Also primer chamber 8 is aligned with bore 16 of a tubular member forming part of a primer loader 52 (FIG. 4) so that both share an essentially common axis 17.

Because of the sizes and mechanical arrangement of the breech block 4,5 there is a gap 18 (FIG. 3) between the end of primer chamber 8 and the end of bore 16 of the primer loader 52. This is a critical feature in the design requirements of the primer loader because the primer cartridge must be pressed fully home into chamber 8 by rammer rod 19 (FIG. 5), which must then be totally withdrawn into bore 16. Failure of either of these will interfere with the closing of upper breech block 5 and so stop the howitzer from firing.

After loading shell and charge (along axis 11) and primer cartridge (along axis 17), lower breech block 4 is closed by movement opposite to that shown by arrow 4A and upper breech block 5 is lowered ( by movement opposite to arrow 5A) to return to the position as shown in FIG. 1.

Figure 4:
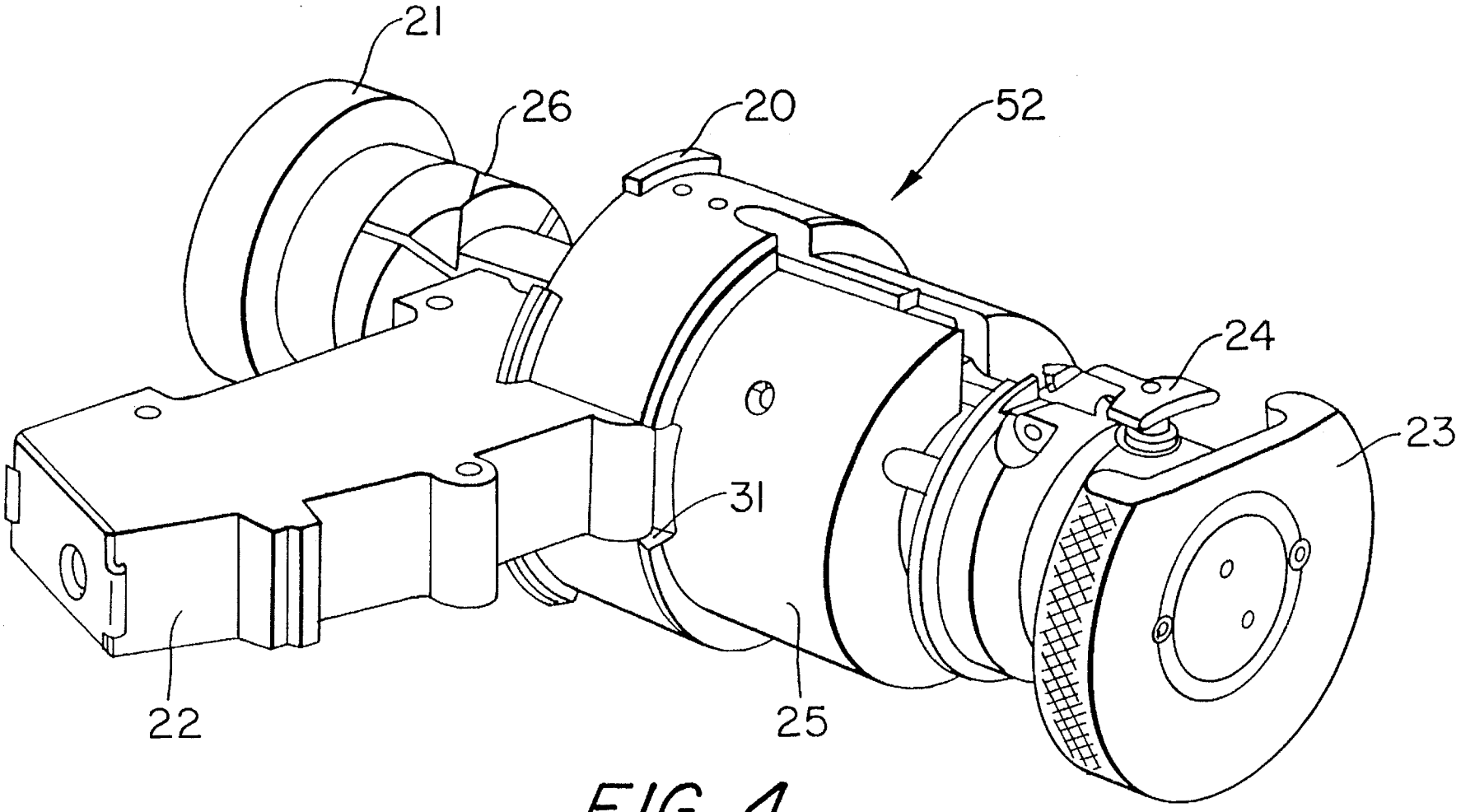
FIG. 4 is a perspective view of a primer loader fitted with a primer magazine for the howitzer of FIG. 1.

FIG. 4 shows the primer loader in perspective. Lug 20 forms part of a bayonet fitting by which the primer loader is secured to the breech ring 15B (FIG. 8) of the howitzer. The front of the primer loader body comprises a locator ring 21 which supports the front end of the loader in a bore of the breech ring and ensures alignment with axis 17 (FIG. 3). The front face 21A of locator ring 21 is aligned in essentially the same plane as the rear face 15A of the breech body guide. Thus when fitted into the breech ring, the primer loader is precisely aligned both axially 17, and positionally 21A–15A with respect to the breech in general and primer cartridge chamber 8 in particular when the breech is fully open.

As shown in FIG. 4 the primer loader includes a driving member in the form of operating handle 23, a sliding bush catch 24, a housing 25 and body 26 and is fitted with a primer magazine 22. The handle 23 is designed for both right and left handed operation.

Figure 5:
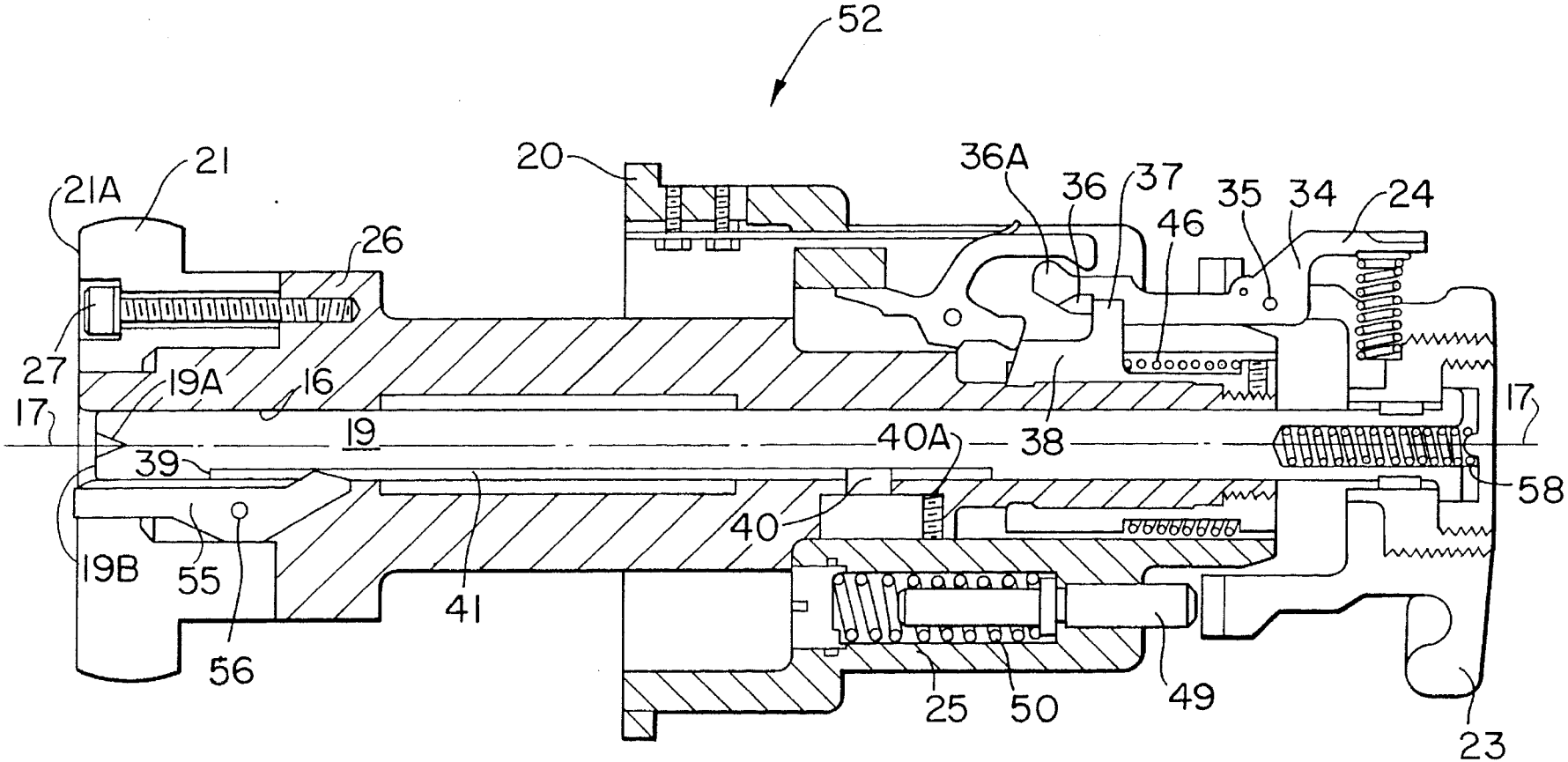
FIG. 5 is an axial sectional elevation through the primer loader of FIG. 4 along the vertical plane.
Figure 6:
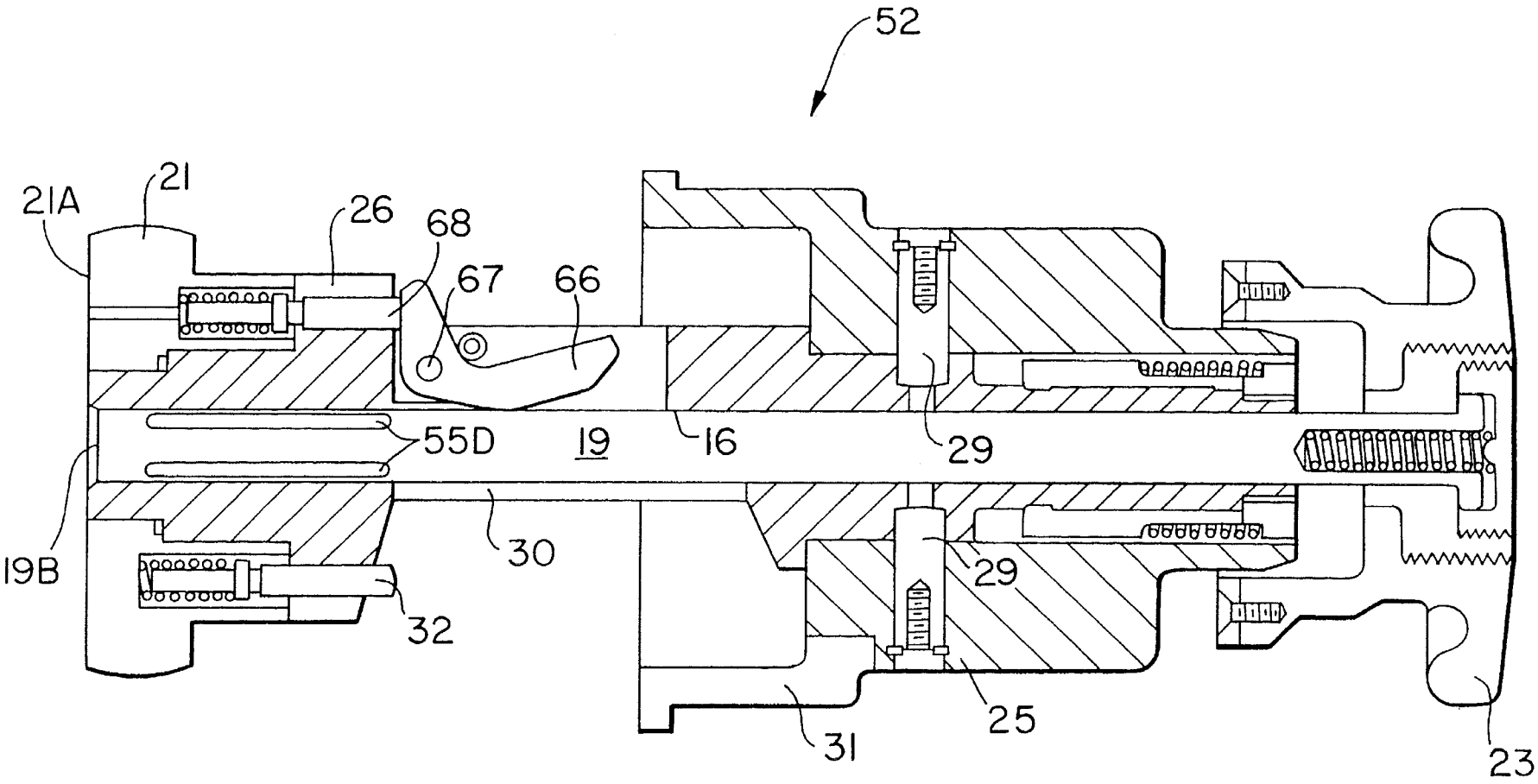
FIG. 6 is a further axial sectional elevation through the primer loader of FIG. 4 in a horizontal plane.

Referring to FIGS. 5 and 6, the body 26 is secured in the housing 25 by dowel pins 29. At the left hand end, locator ring 21 is secured by screws 27. Co-axially within body 26 is the rammer rod 19, which is connected to handle 23 via a spring loaded arrangement 58, which will be described hereinafter. Magazine 22 (FIG. 4) is removably fittable into a slot 30 in body 26. A cut out 31 is provided in housing 25 for the magazine 22 to pass through and also to provide a rigid location. A spring loaded plunger 32 engages with part of the case of magazine 22 to ensure positive, though removable, locking.

It might appear to a casual observer that loading the primer cartridge into chamber 8 of lower breech block 4 is a simple matter of withdrawing handle 23 and rammer rod 1.9, allowing a cartridge 33 to be pushed into bore 16 (FIG. 8) and simply pushing handle 23 home. While this is basically the procedure, it does not recognise the environment under which the loader must operate - and operate with 100% reliability. For example:

(a) Cartridge 33 has to be loaded across a gap 18.

(b) It is possible that it could be loaded while moving. When stationary in a firing position, the howitzer could be violently rocked by the blast, or shrapnel impact, from enemy shells landing nearby.

(c) The howitzer is designed to fire bursts, eg. 3 rounds in 10 seconds. Under these conditions, the gunner is working at peak rate in the hot confines of the self-propelled howitzer with the noises and smells of the battle around him.

(d) Primer cartridge 33 contains a detonator and explosive charge so that there must be no risk of it jamming in the loader or breech or of undue pressure being applied to it.

Figure 7:
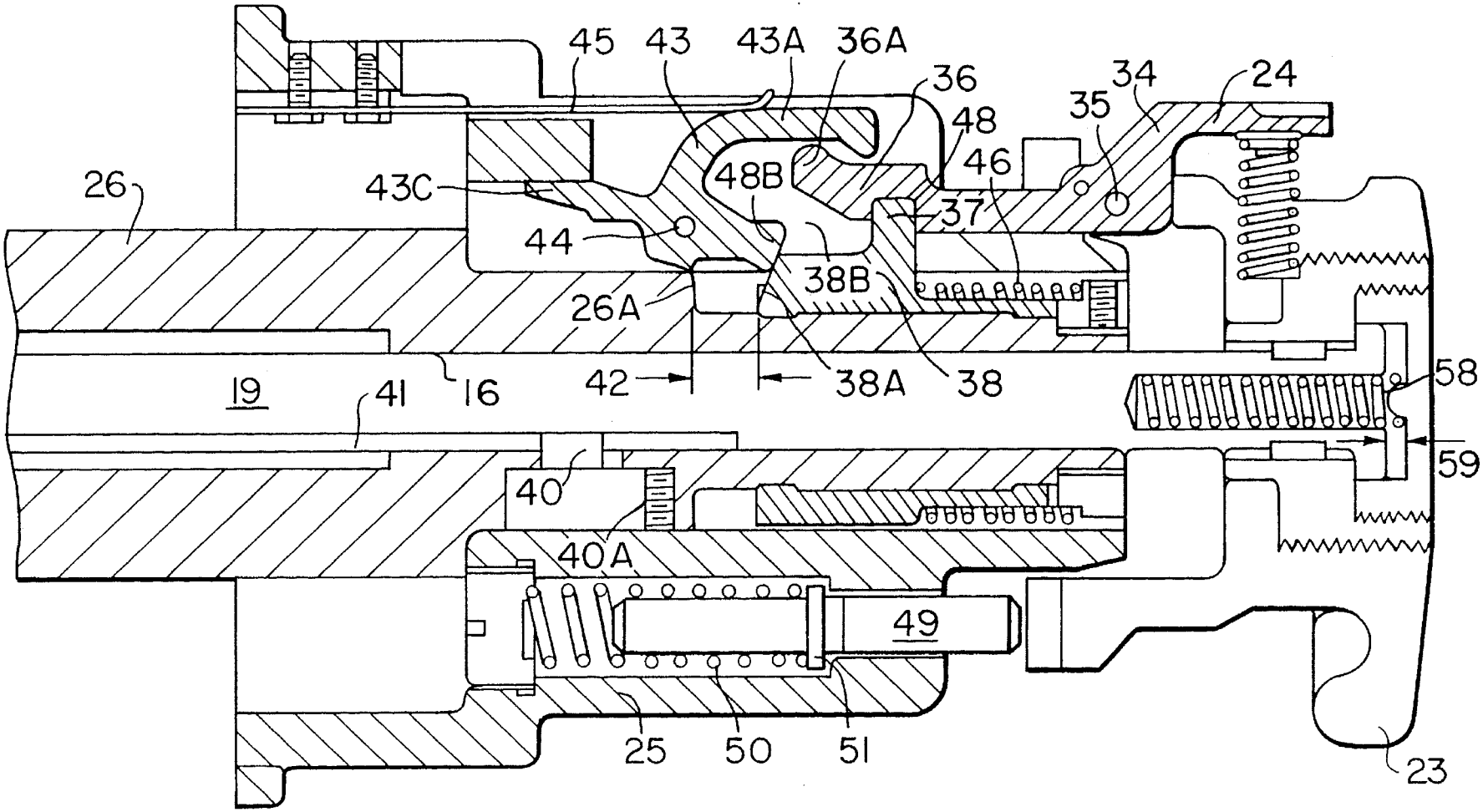
FIG. 7 is a detail of the sectional elevation of FIG. 5 on a larger scale.

Referring to FIGS. 5 and 6, the primer loader is operated by depressing catch 24 with a thumb (right or left hand) and withdrawing rammer rod 19 to its full extent thereby moving it from its second position as shown in FIGS. 5, 6 and 7 to its withdrawn first position. Depressing catch 24 causes lever 34 to pivot about 35 so releasing catch 36 on lug 37 of sliding bush 38. (Parts 34, 36 and 36A are all parts of the same catch 24 but are numbered separately for descriptive convenience). The role of sliding bush 38 will be described hereinafter. Handle 23, rammer rod 19 and catch mechanism 24,34,36 are all withdrawn to the right as far as possible. Key 40 engages with slot 41 in rammer rod 19. The end 39 of slot 41 limits the movement of rammer rod 19 to the right. A buffer 40A acts to stop mechanical damage if handle 23 is pulled back violently against stop 39. The engagement of key 40 in slot 41 stops rotation of rammer rod. 19 about axis 17.

As end 19B of rod 19 clears slot 30 (FIG. 6), a primer cartridge 33 (not shown in FIG. 6) is pushed by spring 63 (FIG. 9) into bore 16. The gunner now pushes handle 23 back to the left to its full extent and then releases it. Because of the action of sliding bush 38, the rammer rod 19 will be pushed to a third position further to the left of the second position shown in FIGS. 5, 6 and 7. The role of sliding bush 38 will now be explained.

FIG. 7 shows sliding bush 38 locked in its 'ready to fire' first position by a first latching mechanism comprising catch 36 on lever 34 and lug 37 on bush 38. In this position, end 38A of bush 38 is separated from face 26A of body 26 by an axial distance 42. When catch 24 is depressed, lever 34 pivots about pin 35 releasing catch 36 from lug 37, allowing handle 23 and rammer rod 19 to be withdrawn to their first position, as previously described. However, at the same time, movement of lever 34 actuates a second latching mechanism comprising stop 43B of latching member 43 and face 38A of bush 38. More particularly end 36A of lever 34 lifts arm 43A of latching member 43 against leaf spring 45 causing it to rotate about pin 44 and move stop 43B out of engagement with the end 38A of the sliding bush 38. Freed from 43B, bush 38 now slides to the left under the action of spring 46 until it reaches a second position with faces 26A and 38A in contact. Stop 43B now rests on the upper surface 38B of bush 38, giving latching member 43 a degree of anti-clockwise rotation from the position shown in FIG. 7.

As handle 23 and rammer rod 19 are pushed back to the left, they pass the second position shown in FIGS. 5, 6 and 7 and continue leftwards to the third position where catch 36 rides up over lug 37 and face 48 of lever 34 contacts lug 37 thereby locking the rammer rod 19 and the sliding bush 38 together. This limits the leftwards movement of the rammer rod 19 and the gunner now releases handle 23, which moves back to the right with the rammer rod 19 under the action of a restoring means comprising three plungers 49 driven by springs 50. Plungers 49 will move until flanges 51 contact housing 25. As springs 50 are stronger than spring 46, bush 38 also slides back a distance 42. Thus, the rammer rod 19 returns to its second position and the bush 38 returns to its first position. When latching member stop 43B clears the top 38B of bush 38, latch 43 rotates clockwise until limited by second stop 43C. Thus, stop 43B and face 38A engage one another and prevent the bush 38 moving to its second position.

It will be noted that when handle 23, etc. complete their leftward motion, latch 43 is rotated anti-clockwise so that end 36A of lever 34 will not normally contact the lip on the underside of arm 43A of latch 43. However, even if catch 24 is inadvertently pressed as handle 23 is pushed fully leftwards, end 36A will only just touch the lip under arm 43A. This is a fail safe aspect of the design to protect the mechanism in the event of minor misuse.

Figure 8:
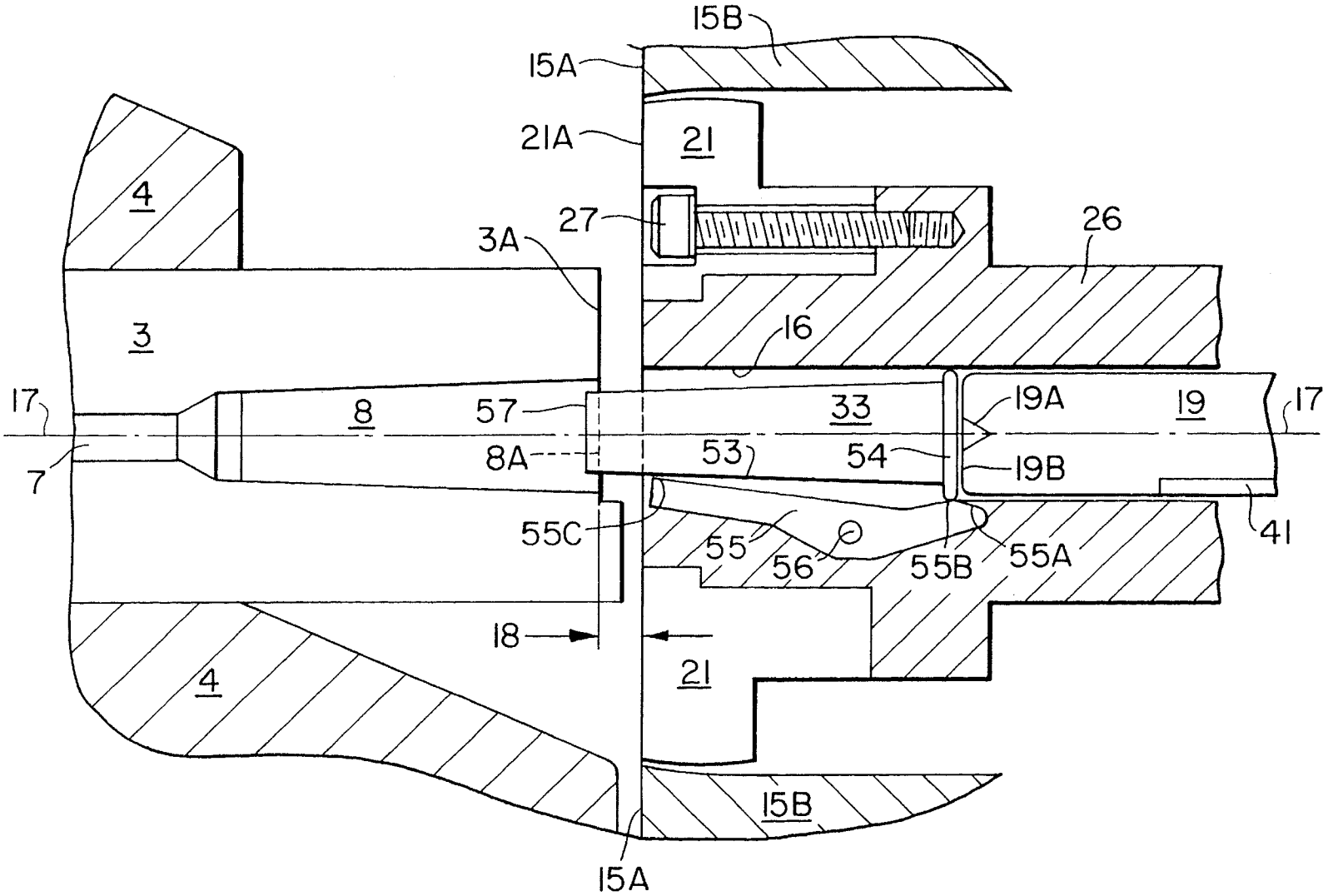
FIG. 8 is a sectional elevation of the primer loader of FIG. 4 showing passage of a primer cartridge into a chamber in a vent axial from the primer loader of FIG. 4.

FIG. 8 shows the situation as primer cartridge 33 leaves bore 16 of primer loader 52, crosses gap 18 and enters chamber 8 in vent axial 3. Primer cartridge 33 is being pushed to the left by rammer rod 19 via the gunner's effort on handle 23. It will be noted that there is an axial depression 19A in the end 19B of rod 19. Depression 19A aligns with the percussion cap (not shown) in the base ring 54 of cartridge 33, so that the pressure from rod 19 is passed via an annulus at end 19B to cartridge base ring 54. This is a further safety feature of the design to ensure that no cartridge 33 is accidentally detonated during loading.

As primer cartridge 33 moves towards the end of bore 16, its slightly tapering cylindrical body 53 contacts three centering fingers 55, which are pivotally mounted about pins 56. Fingers 55 are positioned at 120° C. apart around axis 17 so that only one is visible in the section shown in FIG. 8. As the cartridge base ring 54 contacts lead-in edges 55A of the fingers 55, the fingers 55 pivot so that trailing edges 55C move to touch body 53 of the cartridge 33 and center it on axis 17. The tip 57 of primer cartridge 33 is, at this time, leaving the end of bore 16 and starting to cross gap 18. As base ring 54 moves forward over lead-in edges 55A, the fingers 55 pivot more and the centring action on the primer cartridge 33 increases until, as base ring 54 reaches tips 55B of the lead-in edges 55A, the primer cartridge 33 is located precisely at six points by the fingers 55 ie. three of each of tips 55B and edges 55C. At this point, as shown in FIG. 8, the tip 57 of the primer cartridge 33 has entered mouth 8A of chamber 8 in vent axial 3, ie. the primer cartridge 33 has successfully started to cross gap 18.

As the primer cartridge 33 continues to move to the left, base ring 54 moves past tip 55B so that the centring action becomes marginally less, but this is not important as the cartridge tip 57 is inside chamber 8 and will align the primer cartridge 33 as it advances. Rammer rod 19 will continue to move to the left, beyond the mouth of bore 16 and advance primer cartridge 33 until the base ring 54 is in hard contact with face 3A of vent axial 3. Slots 55D (FIG. 6) are provided in rammer rod 19 to enable the fingers 55 to pivot freely at all stages of the passage of primer cartridge 33 along and out of bore 16.

Figure 11:
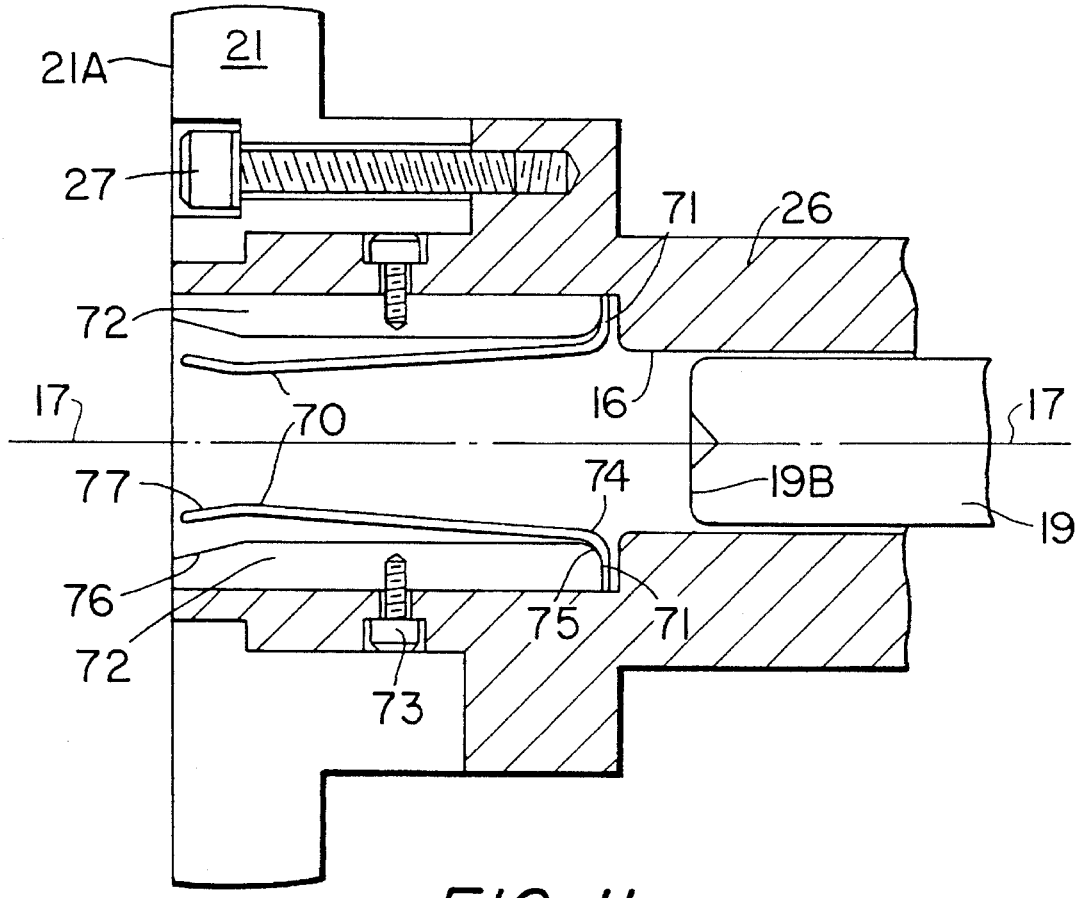
FIG. 11 is a sectional elevation of a part of the primer loader of FIG. 4.

An alternative method of centering and aligning cartridge 33 to cross gap 18 is shown in FIG. 11. Here a plurality of leaf springs 70 is provided. The ends 71 of springs 70 are secured to an annular collar 72 which is secured into body 26 via screws 73. A minimum of three springs 70, is required to give a proper centering action, but more are preferred, symmetrically arranged around bore 16.

As the primer cartridge passes through the bore 16, the springs 70 bend back against the collar 72 as the centering action takes place. It will be noted that springs 70 flex over a large radius arc 74 against a rounded shoulder 75. The end 76 of collar 72 is relieved to accept the curved end 77 of springs 70. These measures are to reduce the bending stresses and eliminate high stress concentrations to ensure a long, trouble-free life for springs 70.

Referring to FIG. 7, handle 23 and rammer rod 19 will advance until face 38A on sliding bush 38 and face 26A on body 26 are in contact (i.e. the second position). This means that the end 19B of rod 19 can advance beyond the mouth of bore 16 by an amount equal to distance 42. Distance 42 is slightly greater than that of gap 18 so that rod 19 always pushes primer cartridge 33 fully into chamber 8 with base ring 54 in hard contact with face 3A of vent axial 3. In order that no undue loading is placed on base ring 54 of primer cartridge 33, there is a resilient connection in the form of a spring 58 between handle 23 and rod 19, which maintains a short axial clearance 59 between the end of rod 19 and the inside of handle 23. As clearance 59 is greater than the difference between distance 42 and gap 18, no force greater than that defined by spring 58 can be placed upon base ring 54 of primer cartridge 33. This is a further safety feature of the invention.

From the foregoing, it will be apparent that, during the loading process, the primer cartridge 33 is fully located at all times between leaving magazine 22 and being fully rammed home into chamber 8. Thus, irrespective of any external influences which may affect the self-propelled howitzer as a whole, there is no risk of the cartridge 33 jamming in the loader or breech mechanisms. This is an important feature of the design and guarantees the reliability of the primer loader 52.

As soon as the cartridge 33 is fully home, the gunner releases handle 23 and the springs 50, acting via the three plungers 49, move handle 23 briskly to the right to the position shown in FIGS. 5 and 7. As thumb catch 24 will have been released, catch 36 will have engaged with lug 37 so that sliding bush 38 will also move to the right under the influence of the springs 50 which cause the weaker spring 46 to be compressed. At the position shown in FIGS. 5 and 7, latching member 43 will rotate clockwise under the influence of leaf spring 45 and first stop 43B will engage with the sliding bush 38. Second stop 43C limits the rotation of latching member 43.

As soon as handle 23 is released after ramming home primer cartridge 33, breech blocks 4 and 5 may start to close, following the reverse directions of arrows 4A and 5A respectively. The closure of breech 4,5 may be initiated automatically via, for example, an electro-mechanical switch, activated by releasing handle 23 which returns to the position shown in FIGS. 5, 6 and 7. Fully closing the breech (FIG. 1) will align vent axial hole 7, cartridge 8 and firing pin 10 all essentially along barrel axis 11. Operation of restraint 12 releases firing pin 11 which strikes the percussion cap (not shown) in the center of the base 54 of cartridge 33. This detonates the primer and the burning gases pass along hole 7, ignite the charge (not shown) and so fire the shell. As a part of the process of opening breech 4,5 afterwards, a catch (not shown) engages the base ring 54 of the cartridge body 53, pulling it out of chamber 8 and ejecting it. Thus the howitzer is ready to be re-loaded with a new shell (via axis 11) and primer cartridge 33 (via axis 17).

The construction and operation of magazine 22 will now be described, as this is an integral part of the primer loader 52. FIG. 4 shows the magazine 22 fitted into the side of the body 26 of loader 52.

Figure 9:
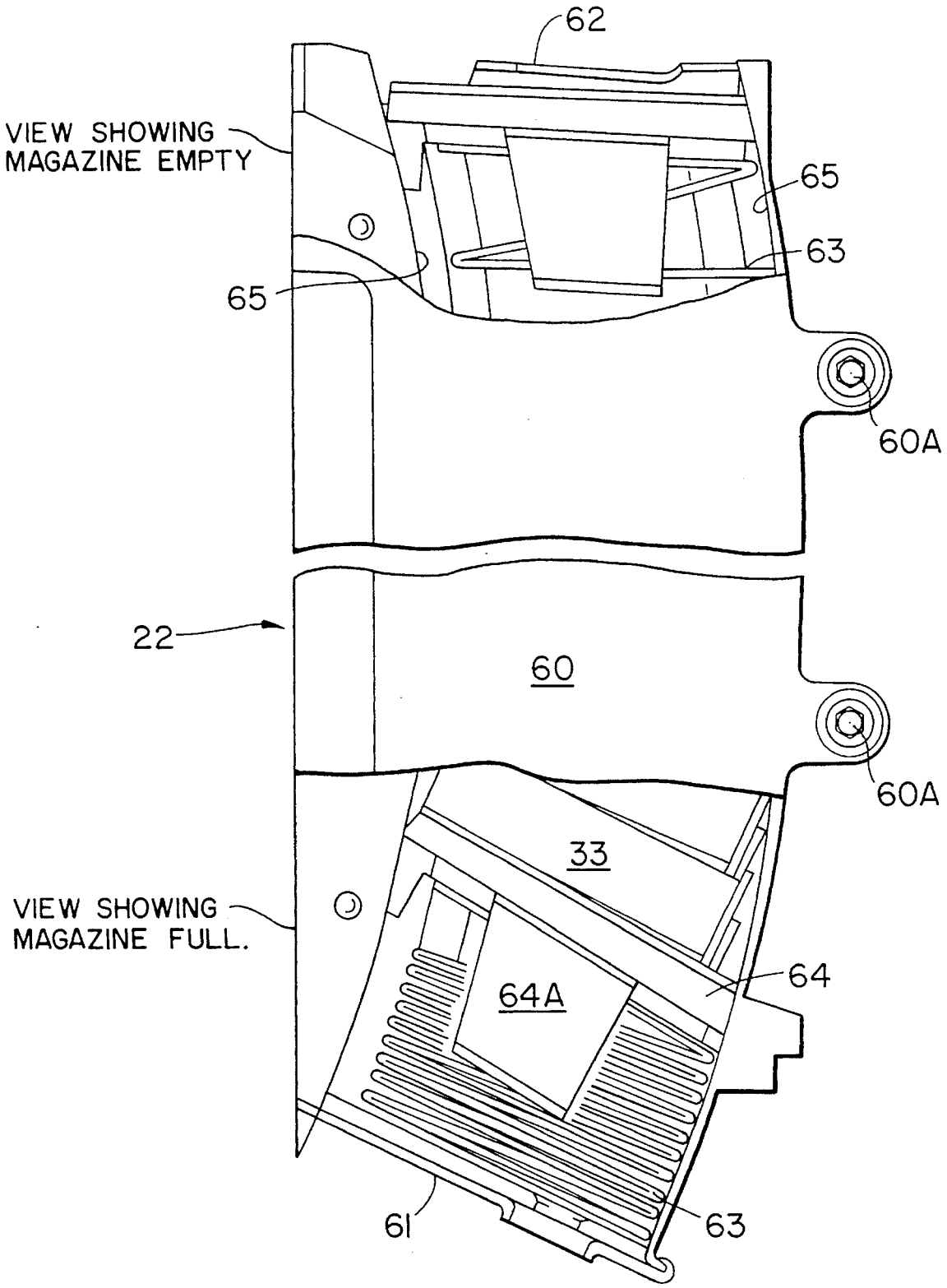
FIG. 9 is a two part sectional plan of the magazine of the primer loader of FIG. 4 showing it in both the fully loaded and unloaded states.
Figure 10:
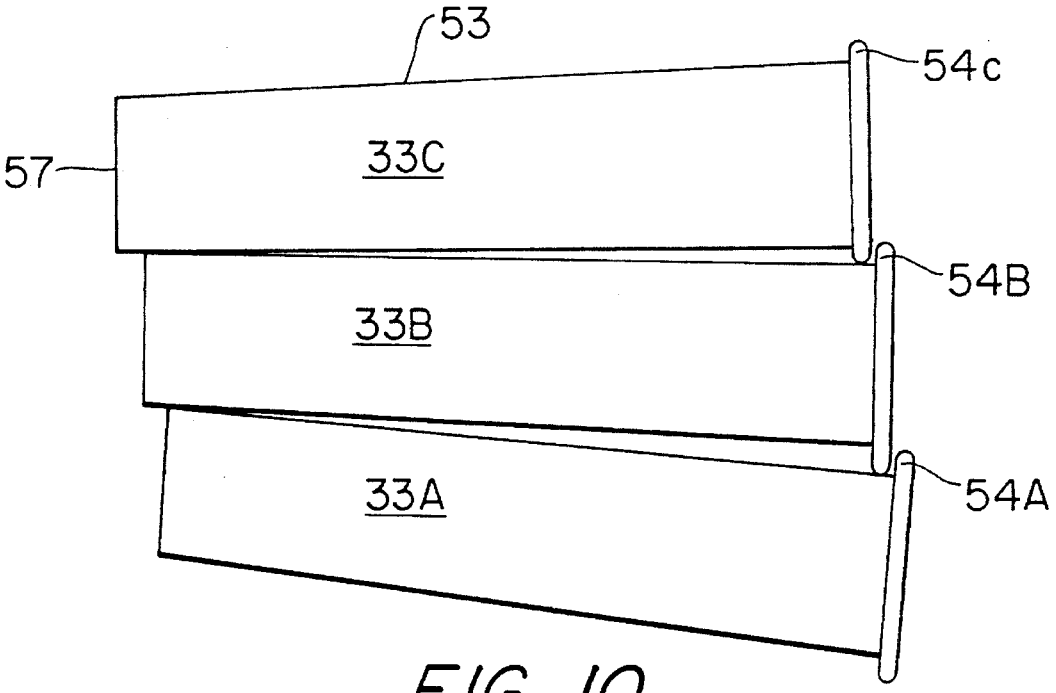
FIG. 10 is an elevation of three primer cartridges closely packed together as they would be in the magazine.

FIG. 9 shows magazine 22 in both the empty (upper) and fully loaded (lower) states. Magazine 22 consists of machined upper and lower plates forming the body 60 and held together by screws 60A. One end 61 is closed by a removable plate and the other has lips 62, which allow primer cartridges 33 to be inserted, yet holds them securely, though partly protruding. A spring 63 urges a platform 64 against the primer cartridge 33. Platform 64 moves in guides 65 along a curved path and has lugs 64A on top and bottom to ensure that it remains substantially at right angles to the line of action of the spring 63. To load the magazine 22, individual primer cartridges are inserted singly between lips 62 and are used to compress spring 63 via platform 64. FIG. 10 shows how the cartridges 33 lie next to each other in the magazine 22. The first cartridge 33A is inserted between lips 62 against the pressure of spring 63. The second cartridge 33B is inserted from the left (as shown in FIG. 9) through the lips 62 and backwards so that the base ring 54B rests against, but in front of base ring 54A (ie. to the left in FIGS. 9,10). The third cartridge 33C is inserted in the same way as 33B and rests with its base ring 54C in front of (ie. to the left of) base ring 54B. As each cartridge is inserted, it urges the previously inserted cartridges along the path defined by guides 65. When full, magazine 22 can hold an appropriate number of primer cartridges 33 for a reasonable level of operation, eg. 15–20. The primer cartridges 33 lie in a close packed double row in magazine 22 as shown (FIG. 9).

The last primer cartridge 33 to be loaded always protrudes slightly between the lips 62. When fitted into the primer loader 52, this last primer 33 protrudes through slot 30 (FIG. 6) into the path of rammer rod 19. Thus, when rod 19 is withdrawn (to the right i.e. the first position) and the end 19B moves fully past slot 30, this last primer 33, under the influence of the spring 63, moves into contact with the lips 62 so partly into the path of rod 19. As rod 19 advances, it catches the base ring 54 of the cartridge and pushes it ahead of it (to the left) bringing it out of the magazine 22 and into bore 16 of the primer loader 52. Further movement of rod 19 loads the primer cartridge 33 as hereinbefore described. As each cartridge leaves the magazine, a further cartridge is moved along the path to the lips 62 as a result of the action of the resilient means 63 on the platform 64.

As each successive primer cartridge 33 enters bore 16, its body 53 bears against misfeed lever 66 (FIG. 6), keeping it pressed back out of bore 16. When all the cartridges 33 in the magazine 22 have been used, retraction of rod 19 will allow spring loaded plunger 68 to rotate lever 66 about pivot pin 67 and into the path of advancing rod 19. This will stop the movement of rod 19 and alert the gunner to replace the empty magazine 22 with a full one. Without a safety device such as this, the gunner could complete the loading sequence, close the breech and try to fire without realising that there was no primer in chamber 8. The resulting delay in trying to identify what was wrong and correcting could have serious consequences either for the howitzer crew themselves, or to personnel in forward locations relying on them for protection.

List of Numbered Items

| | |
|---|---|
| 1 | Barrel |
| 2 | Obturator |
| 3 | Vent axial |
| 3A | Face of vent axial 3 |
| 4 | Lower breech block |
| 4A | Movement of Lower breech block 4 |
| 5 | Upper breech block |
| 5A | Movement of Upper breech block 5 |
| 6 | Vent axial fixing screw |
| 7 | Axial hole in vent axial 3 |
| 8 | Primer cartridge chamber |
| 8A | Mouth of Chamber 8 |
| 9 | Bore of barrel 11 |
| 10 | Firing pin |
| 11 | Axis of barrel 1 |
| 12 | Firing pin shaft |
| 13 | Firing pin spring |
| 14 | Obturator shim |
| 15 | Breech guide |
| 15A | Breech guide |
| 15B | Breech ring |
| 16 | Bore of primer loader |
| 17 | Axis of primer loader |
| 18 | Gap between end of primer chamber 8 and end of bore 16 of primer loader |
| 19 | Rammer rod |
| 19A | Depression at end of rod 19 |
| 19B | End of rod 19 |
| 20 | Lugs |
| 21 | Locator ring |
| 21A | Front face of locator ring 21 |
| 22 | Primer Magazine |
| 23 | Operating handle |
| 24 | Sliding bush catch |
| 25 | Primer loading housing |
| 26 | Primer loading body |
| 27 | Screws |
| 28 | |
| 29 | Dowel pins |
| 30 | Slot in body 26 for magazine 22 |
| 31 | Cut out in housing 25 for magazine 22 |

-continued

| List of Numbered Items | |
|---|---|
| 32 | Spring loaded plunger |
| 33 | Primer cartridge |
| 34 | Lever |
| 35 | Pivot pin |
| 36 | Catch |
| 36A | End of catch 36 |
| 37 | Sliding bush lug |
| 38 | Sliding bush |
| 38A | End face on bush 38 |
| 38B | Top face on bush 38 |
| 39 | Stop at end of slot 40 |
| 40 | Key |
| 41 | Slot |
| 42 | Axial distance |
| 43 | Latching member |
| 43A | Arm on latching member |
| 43B | First stop on latching member 43 |
| 43C | Second stop on latching member 43 |
| 44 | Pivot pin |
| 45 | Leaf spring |
| 46 | Spring |
| 48 | Face of lever 34 |
| 49 | Plungers |
| 50 | Springs |
| 51 | Flanges on plungers 49 |
| 52 | Primer Loader |
| 53 | Cartridge body |
| 54 | Cartridge base ring |
| 55 | Centering Fingers |
| 55A | Centering Fingers, lead-in edge |
| 55B | Centering Fingers, tip of lead-in |
| 55C | Centering Fingers, tip of trailing edge |
| 55D | Slots in rammer rod 19 |
| 56 | Pivot pin |
| 57 | Tip of cartridge 33 |
| 58 | Spring connection |
| 59 | Clearance |
| 60 | Magazine body |
| 60A | Magazine body screws |
| 61 | Magazine - closed end |
| 62 | Magazine - lips |
| 63 | Magazine - spring |
| 64 | Magazine - platform |
| 64A | Magazine - platform lugs |
| 65 | Magazine - platform guides |
| 66 | Misfeed lever |
| 68 | Magazine empty lever pivot |
| 69 | Magazine empty lever plunger |
| 70 | Leaf springs |
| 71 | Ends of springs 70 |
| 72 | Annular collar |
| 73 | Screws |
| 74 | Large radius arc |
| 75 | Rounded shoulder |
| 76 | End of collar 72 |
| 77 | Curved end of springs 70 |

We claim:

1. A primer loader for feeding a primer cartridge into a chamber in a breech block of a gun, which primer loader comprises:

a tubular guide member having a bore constituting a guide for positioning said primer cartridge and being alignable with said chamber of said breech block, and means for moving said primer cartridge along said guide and then into said chamber of said breech block wherein said chamber is separated from the end of said guide adjacent to said breech block so that there is a gap across which said primer cartridge has to pass in order to be placed in said chamber; and said means for moving said primer cartridge along said guide and into said chamber of the breech block is a rod movable within the confines of said guide further wherein the movement of said rod is such that it is (i) retractable to a first position, to allow said primer cartridge to be positioned in said guide at a predetermined location, (ii) advanceable until it first contacts said primer cartridge, and then moves said primer cartridge until said primer cartridge is placed in said chamber at which time said rod is at a second position lying within said guide in said tubular member, (iii) advanceable an additional distance to a third position beyond said second position, said additional distance being not less than the width of said gap so that the further advance of the rod from its second to its third position moves the primer cartridge across the gap and fully into the chamber; and (iv) retractable back into said tubular member after having completed its further advance to said third position.

2. A primer loader as claimed in claim 1 wherein the additional advancement of said rod to said third position is controlled by a bush, slidably mounted for movement between first and second positions in a direction parallel to the direction of movement of said rod with the limit of permitted movement of said bush being not less than the width of said gap.

3. A primer loader as claimed in claim 2 wherein said bush is releasably latchable in its first position and, after releasing, is slidably movable to its second position, which is nearer said gap than said first position of the bush.

4. A primer loader as claimed in claim 3 wherein after said rod and bush have advanced to their said third and second positions respectively, a first latching mechanism is operable to releasably latch together said rod and bush and a restoring means becomes operable to retract both said rod and bush to their said second and first positions respectively and, when said restoring means has retracted said rod and bush to their said second and first positions respectively, a second latching mechanism becomes operable and, in combination with said first latching mechanism, releasably latches said rod and bush against motion in either the retracting or advancing directions.

5. A primer loader as claimed in claim 4 wherein the first and second latching mechanisms are simultaneously released by the operation of a single means enabling the rod to retract from its latchable second position to its first position and allowing the bush to be advanced by a spring from its first latchable position to its second position nearer to the gap and wherein, when the rod reaches its third position, the first latching mechanism re-engages latching the rod and bush together, the second latching mechanism re-establishing itself when the rod and the bush are retracted to their respective second and first positions.

6. A primer loader as claimed in claim 1 further comprising a resilient connection is provided between said rod and a driving member which supplies the advancing force to said rod.

7. A primer loader as claimed in claim 6 wherein the driving member is a manually operable handle and said resilient connection is a spring maintaining an axial clearance between the end of the rod and the operating handle, said axial clearance being greater than the difference in distance between the permitted movement of the bush member and the width of the gap.

8. A primer loader as claimed in claim 7 further comprising a means is provided to align and direct said primer cartridge from said guide in said tubular member across said gap into said chamber in said breech block, said aligning means being in the form of a plurality of pivotally mounted or resilient elements disposed in, or adjacent to, said guide at or near the end of said guide adjacent to said gap.

9. A primer loader as claimed in claim 7 further comprising a magazine for holding a plurality of said primer cartridges and having a mouth through which said primer cartridges may be loaded into said magazine and from which said primer cartridges can pass from the magazine and enter said guide, wherein when said rod is being retracted to its first position it retracts past the mouth of the magazine to allow a primer cartridge to be wholly, or partially, moved into the guide from the magazine.

10. A primer loader as claimed in claim 9, wherein the magazine further comprises:

(a) a body including said mouth and being removably fittable into an opening in said loader so that the mouth is in communication with said guide;

(b) means defining a guide path in said body allowing said primer cartridge to fit within and move along the body to the mouth;

(c) lips, adjacent to said mouth, to hold said primer cartridges in said magazine with one of said primer cartridges protruding into said guide;

(d) a platform, bearing against said primer cartridges and guiding them along said guide path in said body of said magazine;

(e) resilient means to urge said platform into contact with said plurality of primer cartridges and move the remaining of said plurality of primer cartridges to the mouth of said magazine when one of said plurality of primer cartridges has been removed from said mouth of said magazine; and (f) a supply of said primer cartridges.

11. A primer loader as claimed in claim 10 wherein said guide path is curved.

12. A primer loader as claimed in claim 1 further comprising an obturator sealing a breech end of the gun, the breech block further comprising a lower breech block part and an upper breech block part;

wherein (i) said obturator is secured to said lower breech block part and has an axial hole including said chamber and (ii) said breech block opens firstly by said upper breech block part moving rearwards so that the obturator is clear of the barrel, and then upwards so that the chamber is aligned with said tubular guide member.

* * * * *

UNITED STATES PATENT AND TRADEMARK OFFICE

CERTIFICATE OF CORRECTION

PATENT NO. : 5,544,563
DATED : August 13, 1996
INVENTOR(S) : Edwin A. Richards et al.

It is certified that error appears in the above-identified patent and that said Letters Patent is hereby corrected as shown below:

Title page, item [54], and column 1, line 1.
In the title, "LEADER" should read --LOADER--

Title page, item [73]
The second name of the second-named Assignee reads "Ordinance" but should read --Ordnance--.

Signed and Sealed this
Eighteenth Day of March, 1997

Bruce Lehman

BRUCE LEHMAN
*Commissioner of Patents and Trademarks*

*Attest:*

*Attesting Officer*